US005158155A

United States Patent [19]

Domain et al.

[11] Patent Number: 5,158,155

[45] Date of Patent: Oct. 27, 1992

[54] VENDORS' STRUCTURAL COMPLEX

[75] Inventors: Thomas G. Domain, Affton; Philip L. Hogan, III, Ballwin; Michael M. Saigh, St. Louis, all of Mo.

[73] Assignee: VendorsGROUP, Inc., St. Louis, Mo.

[21] Appl. No.: 595,553

[22] Filed: Oct. 11, 1990

[51] Int. Cl.[5] ..... E04H 3/04

[52] U.S. Cl. ..... 186/53; 186/55; 235/383

[58] Field of Search ..... 186/36, 37, 35, 38, 186/41, 52, 53, 55, 56, 22; 235/383

[56] References Cited

U.S. PATENT DOCUMENTS

| | | | |
|---|---|---|---|
| 2,638,636 | 5/1953 | Pool | 186/53 X |
| 3,647,026 | 3/1972 | Alexander et al. | 186/53 |
| 3,876,864 | 4/1975 | Clark et al. | 235/383 X |
| 4,019,605 | 4/1977 | Kropf | 186/22 X |
| 4,073,368 | 2/1978 | Mustapick | 186/53 |
| 4,712,650 | 12/1987 | Campbell | 186/41 |

*Primary Examiner*—F. J. Bartuska

*Attorney, Agent, or Firm*—Rogers, Howell & Haferkamp

[57] ABSTRACT

A Vendors' Structural Complex that provides products and services to consumers in an efficient and cost effective manner comprises a central warehouse having facilities for several separate vendors to store their goods, prepare their goods and perform their services, customer order stations separate and remote from the central warehouse and accessible to consumers in their vehicles enabling the consumers to order the goods and services of the vendors housed in the central warehouse, and several pick-up station locations separate and remote from the central warehouse and accessible to consumers in their vehicles enabling the consumers to receive their ordered goods at the pick-up stations.

24 Claims, 4 Drawing Sheets

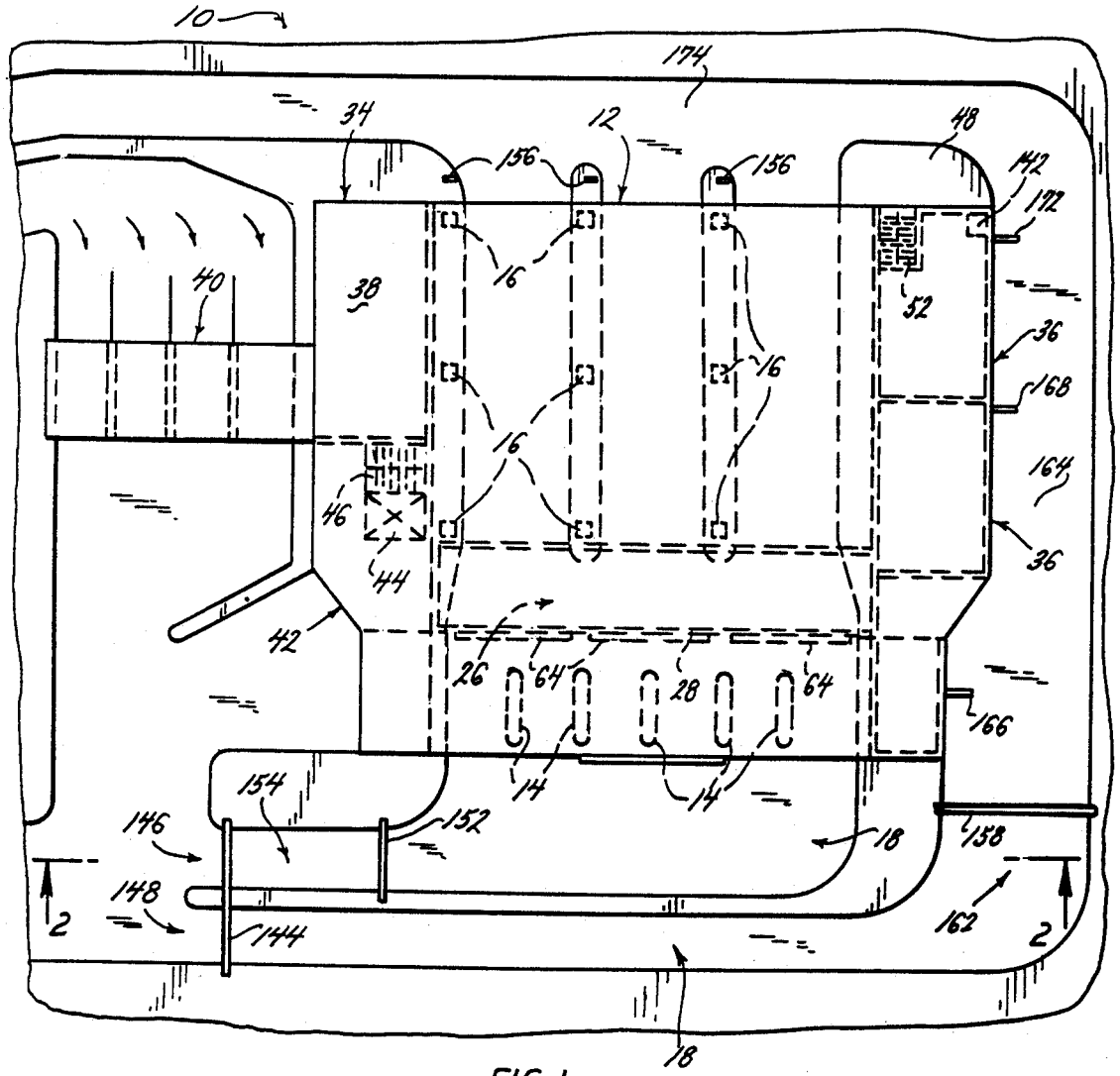
FIG. 1.
FIG. 2.
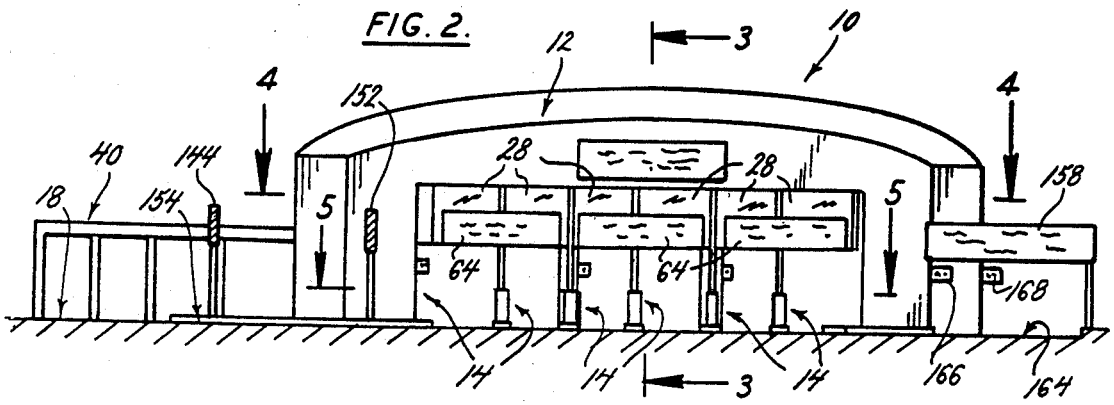

FIG. 6.
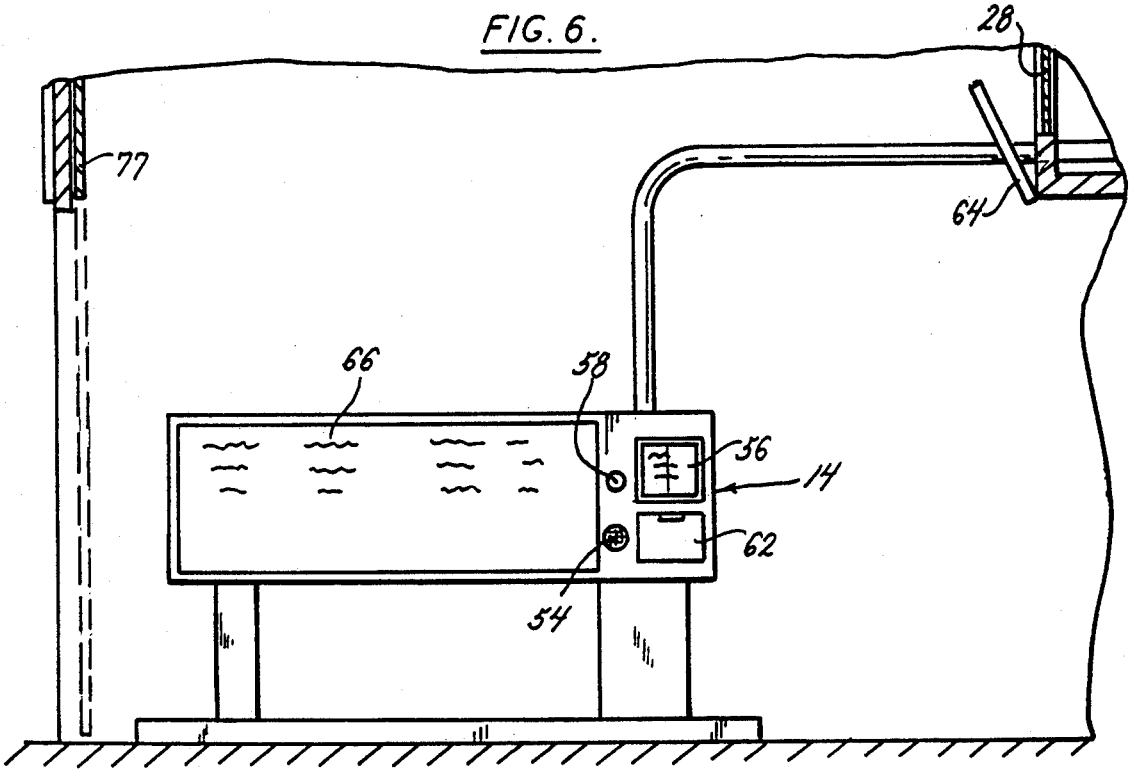
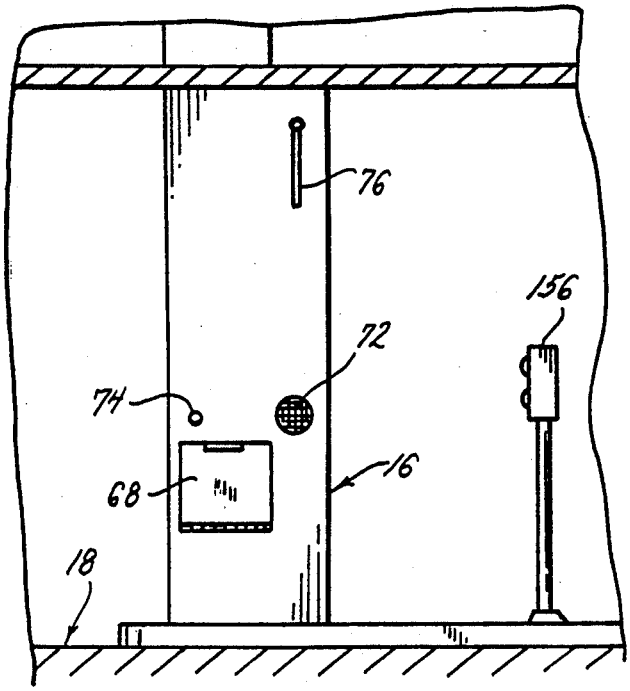
FIG. 8
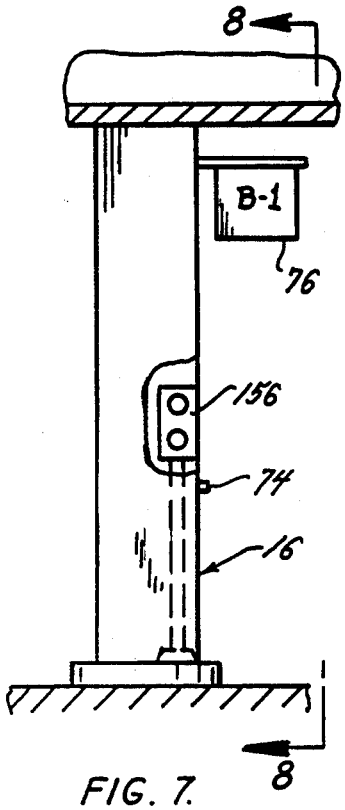
FIG. 7.

VENDORS' STRUCTURAL COMPLEX

BACKGROUND OF THE INVENTION

1) Field of the Invention

The present invention relates to a Vendors' Structural Complex that consolidates several vendors of retail goods and services such as groceries, pharmaceuticals, liquor, key duplication, video rentals, photography development, dry cleaning and laundry, and popular local take-out restaurants, or a single vendor that provides these various goods and services, in a single convenient drive-up Complex.

2) Description of the Related Art

Various types of structural complexes have been employed in the prior art by vendors of retail goods and services for storing goods, performing services and offering the sale of goods and services to consumers. These structural complexes range from smaller facilities with drive-up windows used by fast food restaurants and photo development services, to enclosed shopping malls combining a variety of different retail outlets offering a large variety of goods and services to patrons of the shopping mall. These different types of structural complexes have long been used by vendors of goods and services despite common disadvantages associated with many of these facilities.

A substantial disadvantage encountered by many vendors of goods and services that own or rent a structure or warehouse to store goods, offer their goods for sale, or perform services for consumers is the large cost involved in maintaining the structure or warehouse. Conventional structural facilities used in the sale of consumer goods and services commonly require a substantial area of real estate for the structural facility itself, and a parking lot large enough to accommodate a reasonable number of vehicles of consumers who will visit the facility. Reducing the costs involved in maintaining the structural facility and its surrounding real estate would contribute significantly to reducing the overall costs involved in doing business.

Another disadvantage often encountered by the retailers of goods is the losses they incur through the shoplifting of their goods. Providing a shopping facility that substantially reduces shoplifting would also contribute significantly to reducing costs.

Vendors operating large grocery stores or department stores often find themselves disadvantaged when competing with smaller convenience markets for consumers who are willing to sacrifice a large product selection for convenience. Vendors operating convenience markets often find themselves disadvantaged when competing with the larger grocery and department stores for customers who are willing to sacrifice convenience for a larger product or service selection. Providing a shopping facility that presents a large variety of goods and services to consumers, and enables consumers to receive their desired goods and services in a fast and convenient manner would attract both types of consumers.

Additional disadvantages encountered by most vendors of goods and services include the large start-up costs involved in providing the vendor's goods and services to consumers, the cost involved in maintaining a work force to present the vendor's goods or perform their services for consumers, and the cost involved in advertising and promoting the vendor's individual goods and services. Reducing any or all of these costs would contribute significantly to the success of any business.

The present invention overcomes disadvantages encountered by vendors of retail goods and services by providing a unique Vendors' Structural Complex that brings together vendors of various goods and services, or houses a single vendor of various goods and services in one complex, and correspondingly reduces start-up costs, overhead costs, the costs involved in maintaining a large labor force and in advertising and promoting the individual goods and services of the vendors, and reduces losses incurred by shoplifting. The Vendors' Structural Complex is also easily accessible to consumers from their vehicles, providing a wide selection of goods and services offered by the vendors with drive-up convenience.

It is therefore an object of the present invention to provide a unique and novel Vendors' Structural Complex that combines a single large vendor or several vendors of a variety of different goods and services in one facility and enables each of the vendors to lower their start-up costs, their overhead costs, their advertising and promotional costs, the costs involved in maintaining a large labor force, and substantially eliminates the shoplifting of goods, while providing consumers with the convenience of drive-up shopping and a wide selection of goods and services comparative to that provided by large shopping malls.

SUMMARY OF THE INVENTION

The Vendors' Structural Complex of the present invention is generally comprised of a central warehouse facility, several customer order stations interconnected with the warehouse facility, several customer pick-up stations interconnected with the warehouse facility, and a network of vehicle routing lanes extending through the warehouse facility and passing by the customer order stations and pick-up stations.

Customers using the Complex are directed along the routing lanes to an order station where they place orders for goods and/or services provided by the vendors housed in the Vendors' Complex. The customers are then directed to drive to a particular pick-up station where they receive their ordered goods.

The central warehouse facility of the Vendors' Complex provides a means of storing consumer goods, preparing goods, and performing services for customers of the Vendors' Complex. The Vendors' Complex warehouse is designed to house eight or more satellite restaurants that are locally popular, and whose menu items will be recognized by customers of the Vendors' Complex. In addition to the restaurants, the Vendors' Complex will house vendors of goods such as groceries, pharmaceuticals, liquor, flowers, frozen yogurt and ice cream and other goods. The Complex will also house vendors providing services such as key duplication, video rental, photo developing, dry cleaning and laundry, and other services. The particular mix of goods and services offered will depend on a determination of what goods and services would be most popular in the particular geographic area the Complex is located. The Complex could also be housed by a single vendor providing the variety of goods and services offered. The warehouse is preferably constructed as a two-level structure although a three-level structure could also be employed.

The first floor or ground level of the Vendors' Complex central warehouse is divided into two separate parts. The two parts of the first floor are positioned on opposite sides of the vehicle routing lanes that extend through the Complex.

The first part of the warehouse first floor houses a banking establishment. The bank provides walk-in or drive through facilities to its depositors, or both. Should a banking establishment not be desirable at the particular location of the Complex, the first part of the first floor may alternately be constructed to house a dining atrium. The atrium includes a food item pick-up counter for the satellite restaurants housed in the warehouse, and a seating capacity for approximately 250 dine-in customers of the satellite restaurants. The first part of the first floor also includes a loading dock.

The second part of the first floor houses several vendors of express goods and services. The express vendors provide their goods and services to customers through drive-up windows positioned along an express lane of the vehicle routing lanes, or through a customer walk-up window provided along a sidewalk bordering the second part of the Complex first floor. For example, the second part of the first floor may be employed to house the facilities of a frozen yogurt and ice cream vendor, and/or a dry cleaner and laundry whose goods and services are easily provided to consumers in their vehicles through drive-up windows positioned along the express lane of the vehicle routing lanes. In addition, a grocery express window and walk-up window may be provided in the second part of the Complex first floor. These windows enable delivering grocery orders, previously ordered from the Vendors' Complex by telephone or facsimile, to customers who drive up to the express window in their vehicles or walk up to the walk-up window.

The second floor of the Vendors' Complex is positioned over the first and second parts of the first floor and extends over the vehicle routing lanes passing between the first and second parts of the first floor. The second floor of the Complex provides kitchen facilities for the several restaurants whose food items are available from the Complex. Several clerk units are also provided in the second floor of the Complex just above and forward of the order stations on the ground level of the Vendors' Complex. The clerk units are located above the order stations to provide visual contact between the order clerk employees of the Vendors' Complex manning the units and one or more customers accessing the order stations from their vehicles. The positioning of the clerk units also enables the order clerks to view the vehicle routing lanes of the Vendors' Complex and control the flow of vehicle traffic along the lanes beneath the Complex.

The second floor of the Complex also houses a goods compilation area. The compilation area is a central location of a mechanical conveyor system that communicates with the kitchen and with vendor's goods storage and preparation areas on the second floor of the Complex. The mechanical conveyor system also communicates the goods compilation area with goods storage and preparation areas on the third floor of the Complex in the three floor embodiment of the Complex. The conveyor system also communicates with the individual pick-up station locations on the ground level beneath the Vendors' Complex. The compilation area provides facilities for the employees of the Vendors' Complex to compile goods ordered by customers of the Complex, and to deliver the compiled goods to a particular pick-up station to be received by the customer ordering the goods. In the two story or two level embodiment of the Vendors' Structural Complex, the second floor of the warehouse provides all the storage facilities for the goods of the several vendors housed in the Complex. As stated earlier, each of the individual storage areas of the vendors housed on the second floor communicate with the goods compilation area on the second floor by a mechanical conveyor system employed to deliver the individual vendor's goods from their separate storage or preparation areas to the compilation area on the second floor.

The third floor of the Vendors' Structural Complex in the embodiment of the invention employing a three level central warehouse facility is primarily used in storing the goods of the individual vendors and in providing areas for the vendors to perform services such as photo developing and key duplication.

A customer visiting the Vendors' Complex is directed by the vehicle routing lanes to an open customer order station where they may place their order for goods or services they desire. In the preferred embodiment of the invention there are six customer order stations although the number of order stations may vary depending on available building space and anticipated numbers of customers. Each one of the customer order stations includes a high-quality, two-way audio system and visual system enabling audio and visual communication between the customer at the order station and one of the order clerks in the clerk units of the Vendors' Complex. The visual system includes a high resolution video display terminal and a video camera. Each order station also includes a pneumatic dispatch transfer system.

The pneumatic dispatch system transports tubular carriers between the customer accessing the order station and the clerk processing the customer's order in the Vendors' Complex. The carriers are capable of passing cash, food stamps, checks, credit cards, debit cards, receipts, and various identification cards such as driver licenses and personal I.D. cards between the customer accessing any particular order station and the Vendors' Complex clerk processing the customer's order.

The video display and video camera enable visual communication between the customer accessing the order station and the order clerk of the Vendors' Complex. The video display communicates with a microprocessor terminal used by the order clerk to enter the customer's order, and displays a split screen showing on one side a printed list of the goods ordered by the customer as they are entered into the terminal along with pricing information for the goods entered, and shows on the second side choices of particular types of goods available in a particular category requested by the customer. The video camera is provided i each order station to enable the order clerk of the Vendors' Complex to visually verify the identification of a customer making purchases of liquor or paying for purchases by check.

The customers are assisted in their selection of food items offered by the several local restaurants and available from the Vendors' Complex by a menu display positioned above each order station. Each menu lists the types of foods available and identifies the satellite restaurants that are known for the particular food items. The order stations themselves are provided with a sign board besides the split screen visual display. The signboard displays information on goods and services available and the prices of those goods and services along with advertisements for special sale items.

The communication components of the order stations enable the development and consumation of a complete purchase transaction from the ordering of the goods and services desired, to the payment for the purchase and the delivery to the customer of a receipt and pick-up station location to pick up the goods.

On completing a purchase transaction at the customer order station, the customer is then directed to one of the nine pick-up stations provided beneath the Vendors' Complex. The customer receives instructions from the order clerk as to which pick up station to drive to along with the receipt for their purchase. Three of the nine pick up stations are accessible from each of the customer order stations. Each of the nine pick-up stations includes a dumbwaiter elevator delivery system that receives the ordered goods from the goods compilation area on the second floor of the Vendors' Complex, and delivers the ordered goods to customers at the pick-up stations on the ground level of the Complex. Each pick-up station also includes an audio system that communicates the customer accessing the pick-up station with the goods compilation area on the second floor of the Complex. Audio communication between the customer accessing the pick-up station and an employee of the Vendors' Complex can be triggered by either party as needed. The dumbwaiter elevators communicating the goods compilation area with each of the pick-up stations are also provided with delivery drawers that include pressure controlled side panels that engage and hold the goods delivered by the dumbwaiters and prevent them from spilling over. The drawers extend outward from the pick-up station in such a manner that the customer can remove the goods without getting out of their vehicle in most cases. However, there is sufficient room surrounding the pick-up stations to enable the customer to leave their vehicle to remove the goods from the dumbwaiter if necessary.

A network of vehicle routing lanes directs vehicle traffic to the Vendors' Complex and through the several order stations and pick-up stations beneath the second floor of the Complex. The routing lanes also direct vehicle traffic through the express pick-up lane. The flow of traffic along the vehicle routing lanes is controlled by a series of traffic control lights and traffic sensors positioned along the routing lanes. The traffic control lights are provided at a stacking area of the routing lanes and control the entry of vehicle traffic to the customer order stations and pick-up stations. The traffic control lights also control the flow of traffic along the express lane past the drive-up windows in the second part of the Complex first floor. The traffic control lights are controlled by magnetic sensors positioned in the entry ways to the customer order stations, at the pick-up station locations, and at the express pick-up areas. The operation of the traffic control lights is controlled by a primary computer. However, the computer's control of the lights operation is capable of being overridden by the order clerks of the Vendors' Complex.

From the stacking area of the routing lanes approaching the Vendors' Complex, customers are directed by the traffic control lights to drive their vehicles forward to a particular open order station of the plurality of order stations. Traffic control lights are also provided to inform customers in the stacking area as to when a particular drive-up window is open along the express lane of the routing lanes, and when it is safe to proceed to the drive-up window.

The network of vehicle routing lanes surrounding the Vendors' Structural Complex also includes a lane that passes by an automatic teller machine or a drive through teller facility of the banking establishment located in the Complex, and also directs customers to a vehicle parking area adjacent the banking establishment, or alternately, the atrium dining area on the first floor of the Vendors' Complex.

A mechanical conveyor system communicates each of the vendors housed in the Vendors' Complex with each of the nine pick up stations. The mechanical conveyor system is comprised of a network of motor driven continuous belts or overhead chain loops supporting spaced hooks. The belts or hooks communicate each of the vendors in the Vendors' Complex with the dumbwaiter elevators of the nine pick-up stations. The center of the mechanical conveyor network is a generally square shaped circuit of roller conveyors centrally located in the goods compilation area on the second floor of the Vendors' Complex. From the central circuit of roller conveyors, separate branches of the belt or hook conveyors extend outward to the dumbwaiter elevator locations above the pick up stations on the ground level of the Vendors' Complex. Additional branches of belt or hook conveyors extend outward from the central circuit of roller conveyors to each of the goods storage locations or goods preparation locations of the individual vendors housed in the Vendors' Complex. From each of the separate goods storage and/or preparation areas of the individual vendors on the second floor of the Vendors' Complex, one branch of the belt or hook conveyor system extends to the central circuit of roller conveyors in the goods compilation area on the second floor of the Vendors' Complex.

The kitchen facilities used by the local satellite restaurants housed in the Vendors' Complex are also located on the second floor and also communicate with the central circuit of roller conveyors in the goods compilation area by a branch of the belt or hook conveyors that extends between the kitchen facilities and the goods compilation area.

Additional vendor storage locations may also be located on the third floor of the three floor embodiment of the invention. These storage locations will also communicate with the central circuit of roller conveyors by a branch of the belt or hook conveyors that passes down through the third floor to the goods compilation area on the second floor.

In the embodiment of the invention employing a Vendors' warehouse having only first and second floors, the storage areas of the individual vendors are all located on the second floor of the Complex and all communicate with the goods compilation area by horizontal branches of the belt or hook conveyor network.

The operations of the Vendors' Complex are overseen by a primary computer that monitors the business operations and transactions and the data storage of the Complex. The primary computer also interfaces with the traffic control lights and traffic sensors and controls the sequence of operation of the traffic lights to maintain an ordered flow of customer traffic through the Vendor's Complex.

Microprocessor terminals located in each of the order clerk units and in each of the vendor's areas of the Vendors' Complex interface with the primary computer. The primary computer receives information on goods ordered from the microprocessor terminals, and receives information from each of the individual vendors housed in the Vendors' Complex regarding the consumption of goods, the present stock of goods, breakage of goods and theft data. The primary computer uses this information to maintain a stable stock of goods for each of the individual vendors of the Vendors' Complex based on sales of goods and desired stock levels.

The computerized information network of the Vendors' Complex also includes a printer in each of the individual vendors' goods storage locations in the Vendors' Complex. The printers communicate with each of the microprocessor terminals in the order clerk units and with the primary computer. The information network also includes a printer in the goods compilation area and printers at each of the dumbwaiter elevator locations on the second floor. Each of these printers also communicates with the primary computer and the microprocessor terminals of the order clerk units.

In a typical transaction for the purchase of goods and services provided at the Vendors' Complex, the customer will first enter the Complex by driving their vehicle along the vehicle routing lanes to the stacking area. In the stacking area they will be instructed by the traffic control lights to stop and wait for the next available open customer order station. When a customer order station opens, the traffic control lights will instruct the customer to drive forward to the particular open order station.

As the customer's vehicle arrives at the open customer order station the magnetic traffic sensors at the station will inform the primary computer and the order clerk in the clerk unit communicating with the particular order station that a vehicle has arrived at the order station. Either the primary computer or the clerk will then close the vehicle routing lane for that particular order station by controlling the traffic control lights to indicate that the order station has been closed.

The customer will then present their order for desired goods and/or services to the order clerk by speaking to the clerk through the audio communication system communicating the customer order station with the order clerk unit. As goods and/or services are ordered by the customer, the order clerk enters the goods and/or services into their microprocessor terminal. The list of goods and services ordered and entered into the microprocessor terminal are displayed to the customer on the video display of the customer order station. The video display also shows the customer the price of each of the goods or services ordered, and a total price for the goods and services including tax. When the list of goods and services desired is finalized and a total price is presented to the customer, the customer will then be directed to pay for the purchase with a credit card, check, debit card, food stamps or cash using the pneumatic tube dispatch system. The customer will place the credit card, check, debit card, food stamps or cash in the carrier of the pneumatic tube dispatch system at the order station, and the dispatch system will carry the carrier to the order clerk processing the customers order. Should the customer pay for the purchase by a check or order a liquor purchase, the customer will also be asked to place some form of photo identification, such as a driver's license, in the carrier of the pneumatic tube dispatch system. This will enable the order clerk to verify the identity and age of the customer by viewing the customer through the video camera of the order station and confirming that the customer placing the order is the person shown in the photo identification. When the transaction is complete the order clerk will send a receipt for the purchase, along with the customers' change and their photo identification, if any, through the carrier of the pneumatic dispatch system to the order station where they will be received by the customer. The receipt also identifies which pick up station the customer should proceed to to receive their ordered goods. The customer will then be directed by the order clerk to proceed to their assigned pick up station where their ordered goods will be delivered to them.

As the customer's purchase is finalized, the microprocessor terminal of the order clerk who entered the customer's order sends information to each of the individual vendors of the goods and services ordered. Each vendor's printer then prints out a list of their particular goods and services ordered. Each of the individual vendors assembles their ordered goods and places them in a bag to be hung on the hook conveyor or in a box to be conveyed on the belt conveyor branch communicating the vendor with the compilation area on the second floor.

Vendors' Complex employees in the compilation area then consolidate the goods of each separate order from the individual vendors delivering the goods. The printer at the goods compilation area also prints out a listing of all the goods to be included in the order, and the pick-up station location assigned to the order. The Vendors' Complex goods compilation area assemble the ordered goods sent by the vendors to the compilation area, and verify that each of the goods ordered are present before sending the compiled ordered goods along the mechanical conveyor system to the dumbwaiter elevator location of the assigned pick-up station.

A printer or CRT monitor at the dumbwaiter location of the assigned pick-up station also communicates with the microprocessor terminal of the order clerk. This printer or monitor also prints out a total list of goods to be included in the order assigned to that particular pick-up station. The compiled goods are received by a Vendors' Complex employee at the dumbwaiter elevator location, and the contents of the compiled order are checked once again to make sure they are complete. When the compiled order of goods has been verified at the dumbwaiter elevator location, the Vendors' Complex employee places the ordered goods in the dumbwaiter elevator and sends the goods down to the pick up station where they are received by the customer who ordered the goods.

Once the customer receives their ordered goods from the drawer of the dumbwaiter elevator at the assigned pick up station, they will then proceed from the pick up station location and exit the Vendors' Complex.

BRIEF DESCRIPTION OF THE DRAWINGS

Further objects and features of the present invention are revealed in the following detailed description of the preferred embodiment of the invention and in the drawing figures wherein:

FIG. 1 shows a plan view in section of the Vendors' Structural Complex of the present invention;

FIG. 2 shows a front elevation view of the Vendors' Complex taken along the line 2—2 in FIG. 1;

FIG. 6 shows a side elevation view of a customer order station taken along the line 6—6 in FIG. 5;

FIG. 7 shows a front elevation view of a order pick-up station taken along the line 7—7 in FIG. 5; and FIG. 8 shows a side elevation view of an order pick-up station taken along the line 8—8 in FIG. 7.

DESCRIPTION OF THE PREFERRED EMBODIMENT

Figure 3:
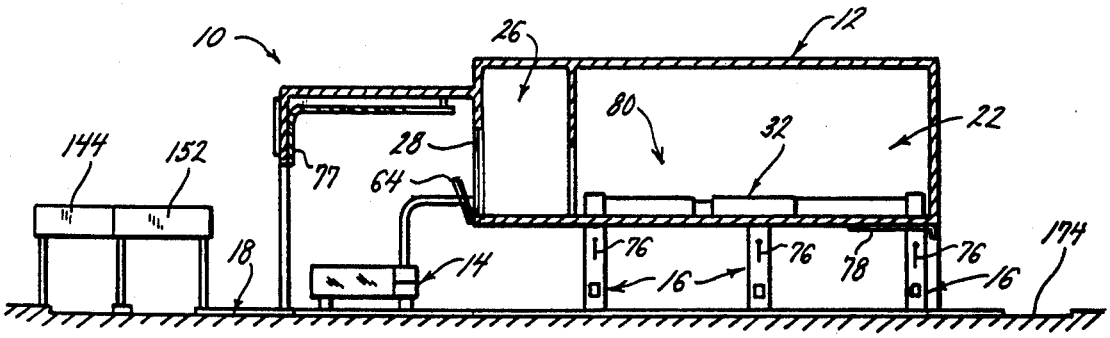
FIG. 3 shows a side elevation view in section of the Vendors' Complex taken along the line 3—3 in FIG. 1.

The Vendors' Complex of the present invention shown in FIG. 1 provides a structural complex that enables consumers to purchase goods and services from a single large vendor of various goods or from a variety of individual vendors of goods and services without exiting their vehicles and entering the Complex.

A plan layout of the Vendors' Structural Complex is shown in FIG. 1. The Vendors' Complex 10 is generally comprised of a central warehouse facility 12, several customer order stations 14 interconnected with the warehouse facility, several customer pick-up stations 16 interconnected with the warehouse facility, and a network of vehicle routing lanes 18 extending to and through the warehouse facility and passing by the customer order stations and pick-up stations. Generally, customers using the Vendors' Complex approach the Complex along the vehicle routing lanes and are directed to one of the customer order stations where they place their order for goods and/or services provided by vendors housed in the Complex. After placing their orders, the customers are then directed to drive their vehicles along the routing lanes to one of the several order pick-up stations where they receive their ordered goods. After receiving their ordered goods, the customers are directed along the vehicle routing lanes to the exit of the Vendors' Complex. The consumers entire shopping excursion including selecting desired goods and services from a variety of different vendors of those goods and services, ordering and paying for the desired goods and services, and receiving the ordered goods takes place without the consumer ever leaving their vehicle and in a correspondingly shorter period of time than heretofore would have been required for such an excursion.

The central warehouse facility 12 of the Vendors' Complex is preferably a structure having two floors, although a warehouse having three floors may be employed in the Complex of the present invention should additional storage area be needed. The warehouse of the Vendors' Complex is primarily intended to house only the vendors of goods and services. Customers of these vendors will not enter the warehouse facility. Because the warehouse is used primarily for storing the goods of several vendors and providing areas for several vendors to perform services they offer to consumers, each of the vendors housed in the Vendors' Complex requires a much smaller area than would be needed in a conventional shopping mall, department store or grocery store complex.

The second floor 22 of the Complex warehouse is primarily used as a storage area for the goods of the vendors housed in the Vendors' Complex, and as an area for performing services by those vendors housed in the Complex who offer services to consumers. For example, the second floor of the warehouse provides sufficient storage space for vendors of groceries (i.e., can and frozen goods, etc.), pharmaceuticals, liquor, flowers, and newspapers, magazines and books. In addition, the second floor will provide sufficient room for vendors providing consumer services such as key duplication, video rentals, photography developing or any other service that lends itself to dumbwaiter elevator delivery.

The second floor 22 of the Vendors' Complex central warehouse houses a large kitchen facility that is used to prepare the food items of the several satellite restaurants offered by the Complex. The warehouse is designed with sufficient room to accommodate the stored goods of several satellite restaurants, preferably eight to ten, on the second floor. There are no facilities for dine-in customers of the restaurants on the second floor. The particular restaurants whose food items are offered by the Complex are chosen from restaurants that are popular in the particular geographic location that the Vendors' Complex is constructed. This is so that customers of the Vendors' Complex will recognize particular prepared foods offered for sale at the Vendors' Complex from the menus of the locally popular restaurants. Refrigerated storage facilities for storing frozen food items prepared by the satellite restaurants are also provided on the second floor 22 of the warehouse.

The second floor of the Vendors' Complex also houses several order clerk units 26. The order clerk units 26 are segmented areas on the second floor of the Complex that are separated from the areas of the second floor used by the vendors of goods and services. The clerk units house work stations used by order clerk employees of the Vendors' Complex that wait on and take the orders for goods and services from customers of the Vendors' Complex. The order clerk units are all located in a line at one side of the Vendors' Complex and are provided with windows 28 overlooking the vehicle routing lanes 18 to enable the order clerk employees to view the vehicles of customers visiting the Vendors' Complex.

The second floor of the Vendors' Complex also houses a goods compilation area 32. The goods compilation area 32 is centrally located on the second floor 24 and is also staffed by Vendors' Complex employees. Goods ordered by the customers of the Vendors' Complex from the several vendors housed in the Complex are compiled in the compilation area before being delivered to the customers in a manner to be explained.

In the three story embodiment of the Vendors' Complex the third floor (not shown) of the Complex is designed primarily to provide additional storage space for the vendors of goods and services housed in the Complex.

The first floor or ground level of the Vendors' Complex is divided into separate first and second structures 34, 36. The first and second structures of the first floor are positioned on opposite sides of the vehicle routing lanes 18 and support the second floor 22 of the Complex above a portion of the vehicle routing lanes.

The first structure 34 of the Complex first floor preferably houses a banking establishment 38. The bank includes drive-up teller facilities 40 as well as walk-up teller windows inside the first floor structure 34. Alternately, the first structure 34 of the Complex first floor houses an atrium 38. The atrium includes a pick-up counter that serves the several satellite restaurants housed in the Complex. The atrium 38 also provides a seating capacity for approximately 250 dine-in customers of the satellite restaurants. Should customers of the Vendors' Complex so desire, they may walk in and order food items from the several restaurants housed in the Complex at the pick-up counter, and then eat their ordered items in the atrium. A loading dock 42 used by the vendors housed in the Complex is also provided in the first structure of the Complex first floor. A freight elevator 44 and a flight of stairs 46 providing access to the second floor of the Vendors' Complex are also provided in the first structure 34 of the Vendors' Complex.

The second structure 36 of the Vendors' Complex first floor is occupied by several vendors of express goods and services. In the preferred embodiment of the invention, three locations are provided in the second structure 36 of the first floor for express vendors. Examples of such vendors include a frozen yogurt and ice cream vendor, a dry cleaning and laundry service, vendors of impulse items such as soft drinks, cigarettes and candy, vendors of packaging/copies, office supplies, and an express grocery pick-up service. Each of these express vendor locations is provided with a drive-up window (not shown) accessible from the vehicle routing lanes. The express grocery is also provided with a walk-up window (not shown) accessible from a sidewalk 48 bordering the second structure 36 of the Complex first floor. From the drive-up or walk-up windows of the express grocery, orders for groceries submitted by telephone of facsimile may be picked up by customers of the Vendors' Complex. The second structure 36 of the Complex first floor also includes a flight of stairs 52 providing access to the second floor of the Vendors' Complex.

A customer visiting the Vendors' Complex places their order for goods or services at one of several customer order stations 14. In the preferred embodiment of the invention, six customer order stations are provided although a lesser or greater number may be provided depending on location demographics. The customer order stations are best seen in FIG. 6.

Each one of the customer order stations 14 includes a two-way audio communication system 54 enabling the customer accessing the order station from their vehicle to speak with one of the order clerks in the order clerk units 26 of the Vendors' Complex.

Each of the order stations 14 also includes a video display terminal 56 that communicates with a microprocessor terminal operated by an order clerk in the order clerk units. The video display terminal 56 displays to the customer accessing the order station 14 a split screen display showing on one side a printed list of goods and services ordered by the customer, and shows on the second side choices of particular types of goods available in a particular category of goods requested by the customer. The display terminal also displays the prices for the itemized goods and services ordered and a total price including tax, as the goods and services are entered into the microprocessor terminal by the order clerk.

The order stations also include a high resolution camera 58 that communicates with a video display in one of the order clerk stations 26. The camera and video display enable an order clerk to verify the identity of a customer paying for a purchase by check or making a liquor purchase. The camera 58 is positioned relative to the order station 14 to provide an accurate picture of the customer accessing the order station. The camera picture is displayed on a video display terminal (not shown) in the clerk unit 26 of the order clerk taking the customer's order. The order clerk compares the video picture of the customer with some sort of picture identification, such as a drivers license, received from the customer to verify the identity and age of the customer making a purchase.

Each of the order stations is also provided with a pneumatic dispatch transfer system 62. The pneumatic dispatch system transports tubular carriers (not shown) between the customer order station and the order clerk unit above the station. The tubular carriers are capable of transporting cash, checks, credit cards, debit cards, food stamps, receipts, and various forms of identification such as driver licenses and personal ID cards, between the customer order station 14 and the order clerk unit 26 above the station.

The customers who drive-up and access an order station 14 are assisted in making their selection of food items of several local satellite restaurants available from the Vendors' Complex by menu displays 64 positioned extending above adjacent pairs of order stations. The menu displays are visible to customers accessing the order stations from their vehicles, and each menu display lists the types of foods available from the Vendors' Complex and the identification of the local restaurants best known for the foods.

Figure 5:
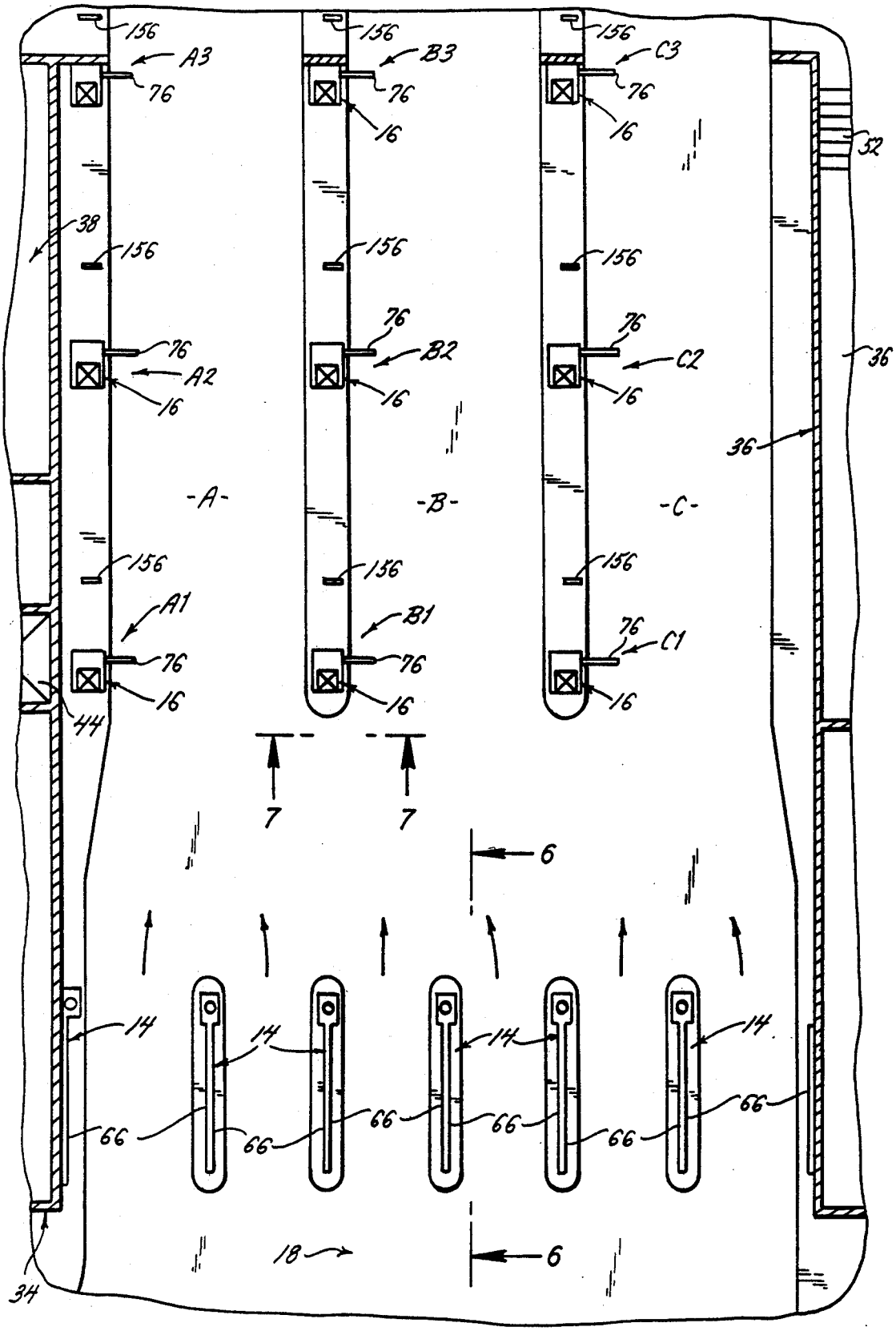
FIG. 5 shows a plan view in section of the Vendors' Complex taken along the line 5—5 in FIG. 2.

Each order station itself is provided with sign boards 66 positioned on opposite sides of the order station and displaying information on goods and services available from the vendors housed in the Vendors' Complex, along with pricing information for the goods and services available and any sales specials currently available. The positioning of the sign boards is best seen in FIG. 5.

The communication components of the order stations enable customers accessing the order stations to develop and consumate a complete purchase transaction from the ordering of desired goods and services from the vendors of the Vendors' Complex, to the payment for the goods and services and the delivery of a receipt and pick-up station location to the customer.

Once a customer has placed their order for goods at one of the customer order stations, the customer receives their ordered goods at one of the several pick-up stations 16. In the preferred embodiment of the invention there are nine pick-up station locations although the number may vary depending on the number of order stations. Three of the nine pick-up stations are accessible from each of the customer order stations along the vehicle routing lanes.

Each of the nine pick-up stations 16 includes a dumbwaiter elevator delivery system that communicates the pick-up station with the second floor 22 of the Vendors' Complex. The dumbwaiter elevator delivery system also includes a delivery drawer 68 that extends outward from the pick-up station. As the drawer extends outward from the pick-up station location, it transfers the goods delivered to the pick-up station location by the dumbwaiter elevator system to a position outside the pick-up station at the proper vehicle window height where the goods are accessible to the customer from their vehicle. This enables the customer to remove the goods from the drawer without getting out of their vehicle in most cases. However, there is sufficient room surrounding the pick-up stations to enable a customer to leave their vehicle to remove the goods from the drawer if necessary. The drawers are also provided with adjustable side panels that engage boxes holding the goods, or alternatively, with hooks that suspend bags holding the goods and prevent the goods from spilling over.

Each of the pick-up stations 16 also includes an audio communication system 72 between the pick-up station and the goods compilation area 32 on the second floor 22 of the Vendors' Complex. The audio communication system enables a customer accessing any pick-up station to communicate with a Vendors' Complex employee loading goods Controls 74 are provided so that audio communication between the customer accessing a pick-up station and the Vendors' Complex employee loading the pick-up station dumbwaiter can be triggered by either party as needed.

Each pick-up station location is also provided with means of visually identifying the station location 76 to assist the customer leaving an order station 14 in finding their assigned pick-up station location.

Each of the order station locations 14 and the pick-up station locations 16 beneath the Vendors' Complex are completely enclosed by a series of automatically closing front 77 and back 78 garage type doors, respectively. The doors protect the stations from vandalism when the Complex is closed.

A mechanical conveyor system 80 interconnects each of the individual vendors' goods storage and goods preparation areas on the second floor of the Vendors' Complex with the goods compilation area 32 in the center of the second floor 24 of the Complex. The conveyor system also communicates the goods compilation area 32 with each of the nine separate dumbwaiter elevators of the customer pick-up stations 16. A schematic representation of the mechanical conveyor system is shown in FIGS. 3 and 4.

The center of the mechanical conveyor system 80 is a generally square shaped circuit of roller conveyors 82 in the goods compilation area 32 on the second floor 22 of the Vendors. Complex. From the center roller conveyor circuit 82, several straight lengths of motor driven conveyors branch out to each of the separate vendors of goods and services on the second 24 floor of the Vendors' Complex, and to eight of the nine dumbwaiter elevators of the separate customer pick-up stations 16. The conveyor branches, although schematically shown, are each motor driven continuous belts or overhead chain loops supporting spaced hooks.

Figure 4:
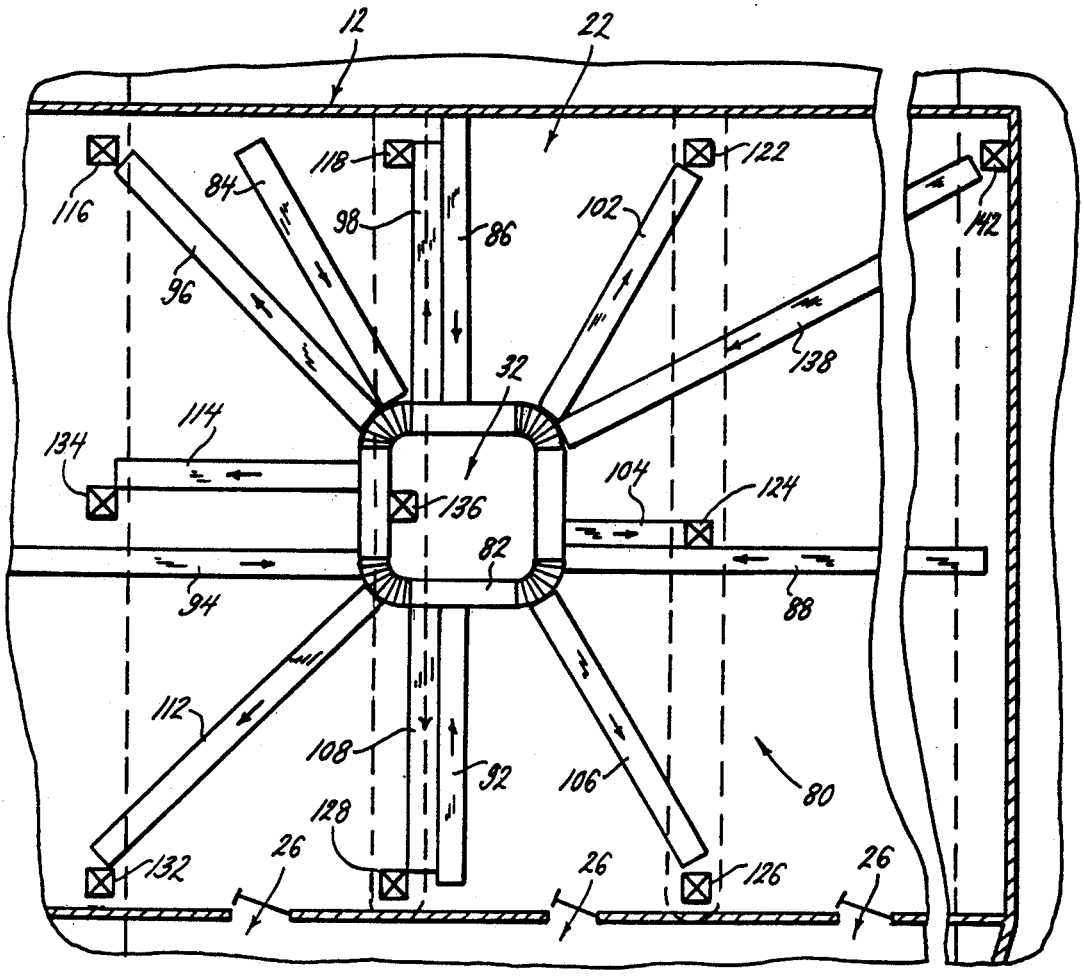
FIG. 4 shows a plan view in section of the Vendors' Complex taken along the line 4—4 in FIG. 2.

In the configuration of the conveyor system shown in FIGS. 3 and 4, several of the straight branches of conveyors 84, 86, 88, 92, 94 extend from separate vendor locations on the second floor 22 of the Vendors' Complex to the goods compilation area 32 in the center of the second floor of the Complex. Each of these branches of conveyors are power driven by a motor so that goods placed in boxes on belt conveyor branches or placed in bags hung on hook conveyor branches will be transported to the center conveyor circuit 82 in the goods compilation area 32.

When goods arrive at the center conveyor circuit 82 in the goods compilation area, Vendors' Complex employees remove the goods from the separate branches of conveyors communicating with the vendors' areas on the second floor and place them on the center conveyor circuit 82. From the center conveyor circuit, the Vendors' Complex employees can transfer the goods along the center circuit to a branch of the conveyor system communicating with the assigned customer pick-up station to which the goods are to be delivered.

One of these branches 94 of the mechanical conveyor system that communicates vendors of goods located on the second floor 22 of the Complex with the center conveyor circuit 82 communicates the single kitchen facility (not shown) located on the second floor of the Complex with the center conveyor circuit 82. Food items of the several satellite restaurants ordered from the Complex are delivered to the center conveyor circuit 82 along the kitchen conveyor 94.

Additional branches of the mechanical conveyor system (not shown) are provided in the three floor embodiment of the invention to communicate vendor storage locations on the third floor of the Complex with the center conveyor circuit 82 on the second floor. These additional branches pas through the third floor and deliver to the center conveyor circuit 82 goods ordered from vendors whose goods storage or goods preparation areas are located on the third floor of the Complex. It should be understood that additional branches of conveyor lengths to additional vendor locations on the second and third floors of the Complex other than those shown may be provided without departing from the scope of the invention.

In the preferred embodiment, a pharmacy and photo developing service are located on the second floor adjacent the order clerk units 26. This positioning enables prescription drugs and developed photos to be delivered directly to the customer at the order station by way of the pneumatic transfer system 62 communicating the clerk units with the order stations.

Eight additional lengths of conveyors branch off from the center conveyor circuit 82 and communicate the center conveyor circuit with eight of the nine separate customer pick-up station locations 16. Goods ordered from the separate vendors and compiled in the goods compilation area 32 are transferred along the center conveyor circuit 82 to one of the eight branches of mechanical conveyors 96, 98, 102, 104, 106, 108, 112, 114 that communicate the center conveyor circuit 82 with the eight pick-up station dumbwaiter elevators 116, 118, 122, 124, 126, 128, 132, 134 respectively.

The ninth pick-up station dumbwaiter elevator 136 is located within the center conveyor circuit and communicates with the center conveyor circuit 82 directly. Goods to be delivered to a customer assigned the pick-up station location corresponding to the dumbwaiter elevator 136 within the center conveyor circuit 82 are removed from the center conveyor circuit by a Vendors' Complex employee and placed in the elevator 136 to be delivered to the customer pick-up station location associated with this elevator.

Goods are delivered to any of the remaining eight customer pick-up station locations 16 by being transported to the particular dumbwaiter elevator by the mechanical conveyor branch communicating the center conveyor circuit 82 with the dumbwaiter elevator associated with the assigned pick-up station location. The goods are then removed from the belt or hook conveyors by a Vendors' Complex employee at the dumbwaiter elevator, and are placed in the elevator for delivery down to the customer awaiting their ordered goods at the assigned pick-up station location.

An additional belt or roller conveyor branch 138 extends outward from the center conveyor circuit 82 to a dumbwaiter elevator 142 communicating with the express grocery pick-up location in the second part of the first floor structure of the Vendors' Complex. Goods ordered by fax or telephone are delivered along the conveyor branch 138 to this dumbwaiter elevator 142 where they are removed from the conveyor and placed in the elevator to be delivered to the express grocery pick-up facility on the first floor. From the first floor the ordered goods are delivered to the customer through the drive-up window or walk-up window of the express grocery facility.

In the embodiment of the invention employing a Vendors' Complex having only first and second floors, the goods storage and preparation areas of each of the individual vendors housed in the Vendors' Complex are all located on the second floor of the Complex and communicate with the goods compilation area by substantially horizontal branches of belt or hook conveyors.

The operations of the Vendors' Complex are overseen by a primary computer (not shown) that monitors the business operations and transactions and the data storage of the individual vendors housed in the Complex. The primary computer interfaces with microprocessor terminals and printers (not shown) located in each of the six order clerk units of the Vendors' Complex.

The order clerk microprocessor terminals and printers are used by the order clerk employees of the Vendors' Complex to enter customers orders for goods and services and to provide the customers with a printed receipt and pick-up station location where they will receive their ordered goods.

Each of the separate individual vendors of goods and services in the Vendors' Complex are also provided with a printer (not shown) that interfaces with the primary computer. The vendors, at their option, may also interface a microprocessor terminal with the primary computer. The terminals may be used by the individual vendors to supply the primary computer with information on goods ordered from the individual vendors. From this information the rate of sale of goods and present stock of goods on hand can be determined for each of the vendors. Information regarding the individual vendors' breakage of goods and theft data may also be input from the vendors' microprocessor terminals. The primary computer uses this information to maintain a stable stock of goods for each of the individual vendors housed in the Complex based on their particular sales data and desired stock levels.

The printers located at each of the individual vendors locations provide information to the vendors of goods and services ordered from each of the vendors as those orders are input to the microprocessor terminals in the order clerk units. The printers also provide the vendors with information identifying each of the separate orders received so that goods ordered from separate vendors can be identified and easily combined in the goods compilation area of the Vendors' Complex.

Additional printers (not shown) are also located in the goods compilation area and at each of the dumbwaiter elevator locations. A CRT monitor may be provided a the dumbwaiter elevator locations in lieu of the printer. Information received at these printers and used by the Vendors' Complex employees in these areas is provided in the form of total lists of goods to be included i each of the separate orders received at the customer order stations and entered by the order clerks. These total lists of goods ordered enable the Vendors' Complex employees at the goods compilation area to compile the goods of separate vendors for each of the separate orders, and enable Vendors' Complex employees at each the dumbwaiter elevator locations to verify that the total list of goods ordered from the separate vendors have been compiled in the order before delivering the order to the assigned pick-up station location by the elevator.

A network of vehicle routing lanes 18 directs vehicle traffic through the Vendors' Complex. The routing lanes channel the flow of vehicles to the six customer order stations 14 and nine customer pick-up stations 16, and through the express pick-up lane. The number of routing lanes will vary as the number of customer order stations varies and the corresponding number of customer pick-up stations vary.

The flow of traffic along the vehicle routing lanes is first met by a lane designation sign 144 directing the customers wishing to access a customer order station to proceed along the left hand lane as viewed in FIG. 1, and directing the customers wishing to access one of the drive-up windows along the express lane to proceed along the right hand lane as viewed in FIG. 1.

Vehicles proceeding along the left hand lane 146 past the direction sign 144 are first met by an order station control display 152. The order station control display 152 displays a listing of all the goods and services available from the Vendors' Complex. The order station control display 152 also displays a series of selectively illuminated lights with numbers corresponding to the number of order stations. In the preferred embodiment of the invention comprising six separate order stations, the order station control display 152 will display a series of six selectively displayed lights bearing the numbers 1–6. The numbered lights alternately display green or red to indicate to a vehicle operator whether a correspondingly numbered order station is opened or closed, respectively. A vehicle proceeding toward the order stations is stopped in the stacking area 154 of the routing lanes until one of the order station lights displayed by the order station control display 152 turns green. The vehicle operator then proceeds forward to the particular numbered order station corresponding to the numbered light displayed as green by the order station control display. As the customers vehicle pulls into the open order station, the magnetic sensors (not shown) provided at the order station sense the presence of the vehicle and inform the order clerk that a vehicle has accessed the order station and control the order station control display 152 to change the display of the order station numbered light from green to red, indicating that the particular order station is now closed.

Once the customer has placed and paid for their order for goods and services at a particular customer order station 14, the customer will be directed by the order clerk to proceed forward to an assigned order pick-up station 16. From the customer order stations, the vehicle routing lanes proceed beneath the second floor 22 of the Vendors' Complex past each of the nine order pick-up stations 16 located beneath the Complex second floor. As is best seen in FIG. 5, from two adjacent customer order stations 14, three of the nine order pick-up stations 16 are accessible along the vehicle routing lanes 18. From the left most pair of order stations 14 shown in FIG. 5, customers are directed to proceed along order pick-up station aisle A. From the center pair of order stations 14, customers are directed to proceed along order pick-up station aisle B. From the right most pair of order stations 14, customers are directed to proceed along order pick-up station aisle C. In addition to a pick-up station aisle designation letter, the customers will also be given a pick-up station designating number directing them to proceed to the first, second or third pick-up stations along the particular designated aisle.

For example, customers accessing the left most pair of order stations 14 shown in FIG. 5 will be directed to proceed to one of the three order pick-up stations A1, A2, or A3 along order pick-up station aisle A. The particular order pick-up stations along aisles B and C are designated in the same manner, that is the stations along aisle B are designated B1, B2 and B3, and the stations along aisle C are designated C1, C2 and C3. Of course the aisle designations and order station pick-up designations will change for embodiments of the invention employing lesser or greater numbers of customer order stations.

As a customers vehicle arrives at a particular order pick-up station location, magnetic sensors (not shown) at the location will indicate to the order clerk in charge of routing vehicles to that location that the particular location is occupied by a vehicle and is closed. The magnetic sensors will also inform the Vendors' Complex employee operating the dumbwaiter location that the customer has accessed the pick-up station location and is awaiting their ordered goods.

A set of STOP/GO signal lights 156 are provided just beyond each pick-up station location 16 in each of the three aisles. The STOP/GO signal lights 156 direct the customer accessing a particular pick-up station location to remain at that location while the light remains red, and then to leave the pick-up station location when the light turns green by pulling to the right in the aisle and passing vehicles stopped at pick-up station locations in front of the customer. When a vehicle leaves a particular pick-up station location 16, the magnetic sensors (not shown) indicate to the order clerk in charge of the particular aisle that a vehicle has left the pick-up station location and that that location is once again open for delivery of goods to a subsequent customer.

Customers entering the vehicle routing lanes 18 of the Vendors' Complex along the right hand express lane 148 first encounter an express window control display 158 directing the customers to stop their vehicles in an express stacking area 162 until their desired express window (not shown) along the express lane 164 has opened. The express window control display 158 alternately displays a green or red light to direct customers in the stacking area 162 of the express lane to wait in the stacking area until their desired express window has opened and the vehicle last accessing the desired express window has exited the express lane. The express window control display will then display a green light directing the customer to proceed forward to their desired express window. As the customer drives their vehicle adjacent the desired express window, magnetic sensors (not shown) at the window location control the express window control display to display a red light indicating the particular express window is closed.

At each of the three express windows in the described preferred embodiment of the invention, there are provided additional stop and go signals 166, 168, 172. The three stop and go signals direct customers accessing a particular express window along the express lane 164 to remain at the express window while the associated light is red, thereby enabling other vehicles to pass the parked vehicles along the right hand side of the express lane 164. When the display light at the express window control display 158 has turned red to stop further vehicle traffic along the express lane 164, the stop and go signals 166, 168, 172 at the express window locations will alternately display green to instruct the customers to exit the express window locations and proceed down the right hand side of the express lane 164 and exit the Complex.

The arrangement of the vehicle routing lanes 18 best seen in FIG. 1 requires that vehicles passing through the Vendors' Complex make only left hand turns to enter, pass through, and exit the Complex. This arrangement of the lanes adds to the ease with which customers may access the customer order stations and pick-up stations and exit the Vendors' Complex.

In the embodiment of the invention housing a dining atrium in lieu of the banking establishment, the network of vehicle routing lanes surrounding the Vendors' Structural Complex also includes a lane that passes by an automatic teller machine of a banking facility (not shown) located remote from the Complex. The vehicle routing lanes also direct customers to a vehicle parking area (not structure of the first floor of the Vendors' Complex.

In a typical transaction at an order station for the purchase of goods and services provided by the vendors housed in the Vendors' Complex, the customer will first enter the Complex by driving their vehicle along the vehicle routing lanes past the lane direction sign 144 to the vehicle stacking area 154 for the order stations 14. There they will be instructed by the order station control display 152 to stop and wait for the next available open customer order station 14. When a customer order station opens, the order station control display 152 will inform the customer which order station has opened and will instruct the customer to drive forward to the particular open order station.

As the customers vehicle arrives at the open order station 14, the magnetic traffic sensors located at that particular station will inform the order clerk in the clerk unit 26 communicating with that particular order station that a vehicle has arrived and has accessed the order station. The magnetic traffic sensors will also cause the order station control display 152 to display that the particular order station is occupied by a vehicle. Alternatively, the clerk may override the primary computer and control the order station control display 152 to display that the particular order station is closed in the event that the primary computer fails to operate the control display lights properly.

The customer next presents their order for desired goods and/or services to the order clerk by speaking to the clerk through the audio communication system 54 communicating the customer order station with the order clerk unit. As goods and/or services are ordered by the customer, the order station clerk enters the goods and/or services into their microprocessor terminal. The list of goods and services ordered and entered are displayed to the customer placing the order on one half of the screen of the video display 56 of the customer order station. Additional choices of particular types of goods available in a particular category requested by the customer are shown on the second side of the split screen. A listing and display of all the items available are provided on the sign boards 66 on opposite sides of the vehicle, and on the overhead menu display 64. The video display also shows the customer the price of each of the individual items ordered and a total price including tax for the ordered goods and services. When the list of goods and services desired is finalized and a taxed total price is presented to the customer, the customer will then be directed to pay for the purchase with a credit card, debit card, food stamps, check or cash using the pneumatic tube dispatch system 62. The customer will place the credit card, debit card, food stamps, check or cash in the carrier of the pneumatic tube dispatch system, and the dispatch system will transfer the carrier to the order clerk processing the customer's order. Should the customer pay for the purchase by a check or order a liquor purchase, the customer will also be asked to place some form of photo identification, such as a drivers license, in the carrier of the pneumatic tube dispatch system. This will enable the order clerk to verify the identity and age of the customer by viewing the customer through the video camera 58 of the order station and confirming that the customer placing the order is the person shown in the photo identification. When the purchase transaction is complete, the order clerk will send a receipt for the purchase, along with the customer's change and photo identification, if any, through the carrier of the pneumatic dispatch system to the order station where they will be received by the customer. The receipt received by the customer also identifies which pick-up station 16 the customer should next proceed to to receive their ordered goods.

As the customer's purchase of goods and services is finalized, the microprocessor terminal of the order clerk who enters the order for goods and services will send information to each of the individual vendors of the goods and services ordered, causing the printers at the particular vendor locations to print a list identifying the goods and services ordered from that vendor. Each of the individual vendors will then assemble their ordered goods and place them in either a box or bag carrier on the belt or hook type conveyor branch, respectively, communicating the vendor with the goods compilation area 32 on the second floor of the Vendors' Complex. The carriers are then transported by the conveyor branches to the center conveyor circuit 82 in the goods compilation area.

The printer or CRT monitor in the goods compilation area 32 will also print out a total list of the goods and services ordered by each of the individual customers accessing an order station. Vendors' Complex employees in the goods compilation area will then compile the goods of each of the individual vendors into a single compiled order according to the list they receive at their printer or monitor. The list showing the goods ordered by each of the individual customers will also show the particular pick-up station location of the nine pick-up station locations to which each order is to be sent. The Vendors' Complex employees in the goods compilation area verify that each of the goods ordered is present in the compiled total order before sending the compiled total order of goods along the conveyor branch communicating with the dumbwaiter elevator of the assigned pick-up station.

The printer or CRT monitor at the dumbwaiter elevator of the assigned pick-up station location will also print out a total listing of the goods ordered by the particular customer assigned to that pick-up station location. The total compiled goods of each order are received by a Vendors' Complex employee at the dumbwaiter elevator location, and the contents of the compiled order are checked once again to make sure they are complete. When the compiled order of goods has been verified at the dumbwaiter elevator location, the Vendors' Complex employee then places the goods in the dumbwaiter elevator and sends the goods down to the pick-up station location where they are received by the customer who ordered the goods. The dumbwaiter elevator will deliver the ordered goods down to the drawer 68 of the assigned pick-up station location, and the drawer will automatically extend outward to present the ordered goods to the customer waiting at the pick-up station.

Once the customer receives their ordered goods from the drawer of the pick-up station location, they will then proceed from the pick-up station location along the vehicle routing lanes 18 to the exit lane 174 and will then exit the Vendors' Complex.

While the present invention has been described by reference to specific embodiments, it should be understood that modifications and variations of the invention may be constructed without departing from the scope of the invention defined in the following claims.

What is claimed is:

1. A structural complex arranged to provide products and services to consumers in an efficient and cost effective manner, the complex comprising:

warehouse means providing facilities for storing and preparing goods and preforming services;

order stations means separate and remote from the warehouse means and communicating with the warehouse means, the order station means being accessible to consumers to enable consumers to communicate with the warehouse means to order goods, services or both from the warehouse means;

pick up station means separate and remote from the warehouse means and separate and remote from the order station means, the pick up station means communicating with the warehouse means, the pick up station means being accessible to consumers to enable consumers to receive at the pick up station means goods, services, or both ordered from the warehouse means at the order station means;

the warehouse means being elevated relative to the order station means and the pick up station means, with the order station means and pick up station means being positioned below the warehouse means;

a vehicle route passing through the structural complex beneath the warehouse means and passing adjacent the order station means and then passing adjacent the pick up station means, the vehicle route enabling consumers in vehicles to access the order station means and the pick up station means from the vehicle route; and, the warehouse means having first and second doors supported over the vehicle route, the first and second doors being opened to provide access to the order station means and the pick up station means from the vehicle route and the first and second doors being closed to completely enclose the order station means and the pick up station means beneath the warehouse means.

2. The structural complex of claim 1, wherein:

a first communicating means is interconnected between the order station means and the warehouse means, the first communicating means including electrical communication means and mechanical communication means.

3. The structural complex of claim 3, wherein:

a second communicating means is interconnected between the pick up station means and the warehouse means, the second communicating means including electrical communication means and mechanical communication means.

4. The structural complex of claim 3, wherein:
the electrical communication means includes electronic circuitry operatively connected between the order station means and the warehouse means, and the mechanical communication means includes a pneumatic dispatch system operatively connected between the order station means and the warehouse means.

5. The structural complex of claim 4, wherein:
the electrical communication means of the second communicating means includes electronic circuitry operatively connected between the pick up station means and the warehouse means, and the mechanical communication means of the second communicating means includes a dumbwaiter elevator system operatively connected between the pick up station means and the warehouse means.

6. The structural complex of claim 1, wherein:
the order station means includes a plurality of order stations each accessible to consumers in vehicles from the vehicle route, and the pick up station means includes a plurality of pick up stations each accessible to consumers in vehicles from the vehicle route.

7. The structural complex of claim 6, wherein:
a traffic control means is provided adjacent to the vehicle route, the traffic control means provides consumers in vehicles with a present visual indication of each order station of the plurality of order stations currently being accessed by consumers.

8. The structural complex of claim 6, wherein:
the vehicle route is subdivided into a plurality of lanes with each lane passing adjacent to a single order station of the plurality of order stations.

9. A structural complex arranged to provide products and services to consumers in an efficient and cost effective manner, the complex comprising:
warehouse means providing facilities for storing and preparing goods and performing services;
order station means accessible to consumers;
first electrical communication means and first mechanical communication means operatively connected between the order station means and the warehouse means enabling consumers to communicate with the warehouse means from the order station means;
pick up station means accessible to consumers; and
second electrical communication means and second mechanical communication means operatively connected between the pick up station means and the warehouse means enabling consumers to communicate with the warehouse means from the pick up station means;
the warehouse means being elevated relative to the order station means and the pick up station means, with the order station means and pick up station means being positioned below the warehouse means;
a vehicle route passing through the structural complex beneath the warehouse means and passing adjacent the order station means and then passing adjacent the pick up station means, the vehicle route enabling consumers in vehicles to access the order station means and the pick up station means from the vehicle route; and,
the warehouse means having first and second doors supported over the vehicle route, the first and second doors being opened to provide access to the order station means and the pick up station means from the vehicle route and the first and second doors being closed to completely enclose the order station means and the pick up station means beneath the warehouse means.

10. The structural complex of claim 9, wherein:
the first electrical communication means includes a two-way audio system enabling verbal communication between the order station means and the warehouse means and a video display and video camera in the order station means enabling visual communication between the order station means and the warehouse means.

11. The structural complex of claim 9, wherein:
the first mechanical communication means includes a pneumatic dispatch system having a carrier transferable through the system between the order station means and the warehouse means.

12. The structural complex of claim 9, wherein:
the second electrical communication means includes a two-way audio system enabling verbal communication between the pick up station means and the warehouse means.

13. The structural complex of claim 9, wherein:
the second mechanical communication means includes a dumbwaiter elevator system having an elevator transferable through the elevator system between the pick up station means and the warehouse station means.

14. The structural complex of claim 10, wherein:
the video camera in the order station means communicates a visual image of a consumer accessing the order station means to the warehouse means.

15. A structural complex arranged to provide products and services to consumers in an efficient and cost effective manner, the complex comprising:
warehouse means providing facilities for storing and preparing goods and performing services;
pick up station means separate and remote from the warehouse means and accessible to consumers;
mechanical communication means operatively connected between the pick up station means and the warehouse means enabling goods to be transferred from the warehouse means to the pick up station means and received by consumers with access to the pick up station means;
the warehouse means being elevated relative to the pick up station means with the pick up station means being positioned below the warehouse means;
a vehicle route passing through the structural complex beneath the warehouse means and passing adjacent the pick up station means enabling consumers in vehicles to access the pick up station means from the vehicle route; and,
the warehouse means having first and second doors supported over the vehicle route, the first and second doors being opened to provide access to the pick up station means from the vehicle route and the first and second doors being closed to completely enclose the pick up station means beneath the warehouse means.

16. The structural complex of claim 15, wherein:
the mechanical communication means includes a dumbwaiter elevator system operatively connected between the pick up station means and the warehouse means.

17. The structural complex of claim 15, wherein:

the warehouse means includes at least one goods storage facility, at least one goods preparation facility, at least one service provision facility, and a goods compilation facility, all of the facilities being separate from each other, and the mechanical communication means being operatively connected between the goods compilation facility and the goods storage facility, the goods preparation facility, and the service provision facility.

18. The structural complex of claim 17, wherein:

the mechanical communication moans is a mechanical conveyor system.

19. The structural complex of claim 16, wherein:

the mechanical communication means includes a mechanical conveyor system operatively connected between the dumbwaiter elevator system and the warehouse means.

20. The structural complex of claim 17, wherein:

the mechanical communication means includes a mechanical conveyor and a dumbwaiter elevator system, the mechanical conveyor being operatively connected between the goods compilation facility and the dumbwaiter elevator system and the dumbwaiter elevator system being operatively connected between the mechanical conveyor and the pick up station means.

21. The structural complex of claim 15, wherein:

the pick up station means includes a plurality of pick up stations with each of the stations being accessible to consumers.

22. The structural complex of claim 21, wherein:

the mechanical communication means includes a plurality of dumbwaiter elevators with each elevator being associated with a pick up station.

23. The structural complex of claim 22, wherein:

the mechanical communication means includes a plurality of mechanical conveyors with each conveyor operatively connecting a dumbwaiter elevator with the warehouse means.

24. The structural complex of claim 23, wherein:

the warehouse means includes a plurality of goods storage facilities and a plurality of goods preparation facilities, the facilities being separate from each other and the plurality of mechanical conveyors being operatively connected between each of the facilities and the plurality of dumbwaiter elevators.

* * * * *